US009375856B2

(12) United States Patent
Bennik et al.

(10) Patent No.: US 9,375,856 B2
(45) Date of Patent: Jun. 28, 2016

(54) SHAVING DEVICE

(75) Inventors: Jan Bennik, Drachten (NL); Gerben Raap, Drachten (NL); Mark Johannes Lelieveld, Drachten (NL); Jasper Zuidervaart, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 54 days.

(21) Appl. No.: 13/509,732

(22) PCT Filed: Dec. 8, 2010

(86) PCT No.: PCT/IB2010/055672
§ 371 (c)(1),
(2), (4) Date: May 14, 2012

(87) PCT Pub. No.: WO2011/073858
PCT Pub. Date: Jun. 23, 2011

(65) Prior Publication Data

US 2012/0311863 A1 Dec. 13, 2012

(30) Foreign Application Priority Data

Dec. 15, 2009 (EP) ..... 09179190

(51) Int. Cl.
*B26B 21/44* (2006.01)
*B26B 21/52* (2006.01)

(52) U.S. Cl.
CPC ..... *B26B 21/446* (2013.01); *B26B 21/521* (2013.01); *B26B 21/522* (2013.01)

(58) Field of Classification Search
USPC ..... 30/526, 535, 538, 123.3, 537, 540, 30/41.5, 41; 15/167.1
See application file for complete search history.

(56) References Cited

U.S. PATENT DOCUMENTS

| | | | | | |
|---|---|---|---|---|---|
| 2,019,957 | A * | 11/1935 | England | 30/32 |
| 3,783,511 | A * | 1/1974 | Pass | 30/41 |
| 4,074,429 | A * | 2/1978 | Roberts | 30/41 |
| 4,791,723 | A * | 12/1988 | Jacobson | 30/41 |
| 4,809,432 | A * | 3/1989 | Schauble | 30/41 |
| 4,974,319 | A * | 12/1990 | Maguire et al. | 30/41 |
| 5,168,628 | A * | 12/1992 | Mock et al. | 30/41 |
| 5,564,190 | A * | 10/1996 | Fleetwood | 30/41 |
| 6,406,157 | B1 * | 6/2002 | Audet | 362/115 |
| 6,789,321 | B2 * | 9/2004 | Simms | 30/41 |
| 7,137,203 | B2 * | 11/2006 | Bressler et al. | 30/41 |
| 7,234,239 | B2 * | 6/2007 | Saito et al. | 30/41 |

(Continued)

FOREIGN PATENT DOCUMENTS

| | | |
|---|---|---|
| DE | 202007002013 U1 | 4/2007 |
| EP | 0463992 A1 | 1/1992 |

(Continued)

*Primary Examiner* — Omar Flores Sanchez

(57) ABSTRACT

A shaving device (1, 21) comprises a handle (2) provided with a reservoir (6) for holding a fluid, a treatment device (4, 24) provided with at least one shaver element (5), which treatment device (4, 24) is pivotable with respect to the handle (2), and a fluid channel (7) extending from the reservoir (6) to an outlet opening (8, 28) at least near the treatment device (4, 24). At least a part of the fluid channel (7) is elastically deformable from a closed position, in which the passage through the fluid channel (7) is closed off, to an opened position, in which the passage through the fluid channel (7) is opened by pivoting the handle (2) with respect to the treatment device (4, 24) from a rest position to an activated position, and vice versa.

8 Claims, 2 Drawing Sheets

(56) References Cited

U.S. PATENT DOCUMENTS

| | | | | |
|---|---|---|---|---|
| 7,703,361 | B2 | 4/2010 | Johnson | |
| 8,529,150 | B2 * | 9/2013 | Olson | 401/286 |
| 2005/0023351 | A1 | 2/2005 | Patel et al. | |
| 2005/0123342 | A1 | 6/2005 | Bressler et al. | |
| 2005/0144786 | A1 | 7/2005 | Bressler et al. | |
| 2008/0016692 | A1 * | 1/2008 | Noble | 30/41.5 |
| 2008/0216321 | A1 * | 9/2008 | Guimont et al. | 30/41 |
| 2010/0095529 | A1 * | 4/2010 | Hawes et al. | 30/41.5 |
| 2011/0219624 | A1 * | 9/2011 | Rockell et al. | 30/41 |
| 2012/0167393 | A1 * | 7/2012 | Lelieveld et al. | 30/41 |
| 2012/0311863 | A1 | 12/2012 | Bennik | |

FOREIGN PATENT DOCUMENTS

| | | | |
|---|---|---|---|
| EP | 2512762 | A1 | 10/2012 |
| FR | 2634154 | A1 | 1/1990 |
| WO | 0047374 | A1 | 8/2000 |
| WO | 2008152601 | A1 | 12/2008 |

* cited by examiner

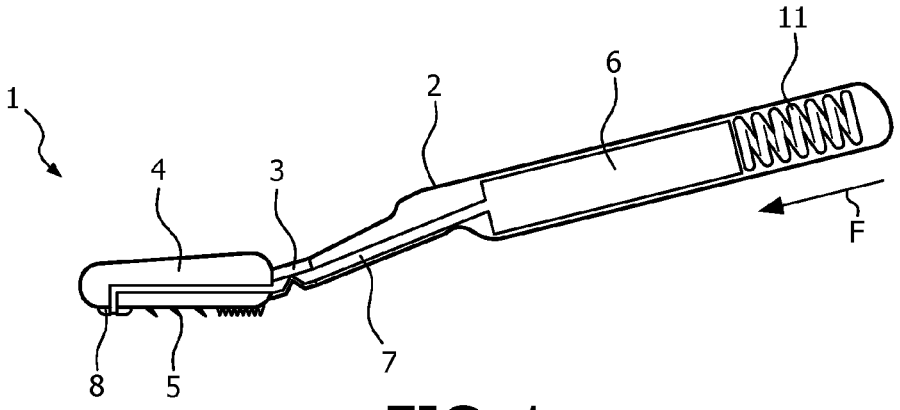
FIG. 1
FIG. 2A
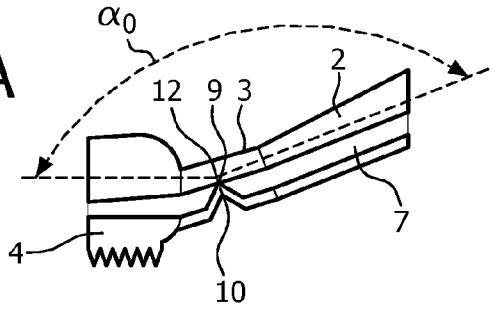
FIG. 2B
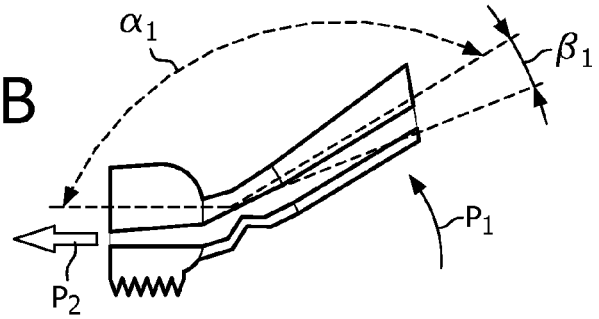
FIG. 2C
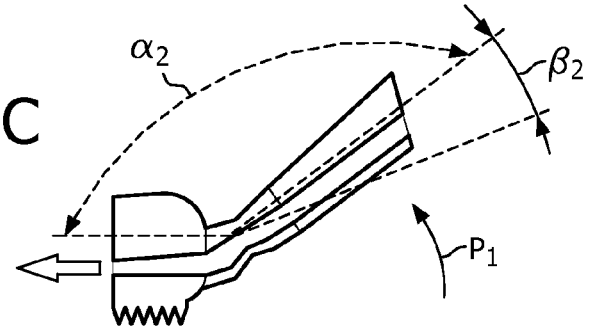

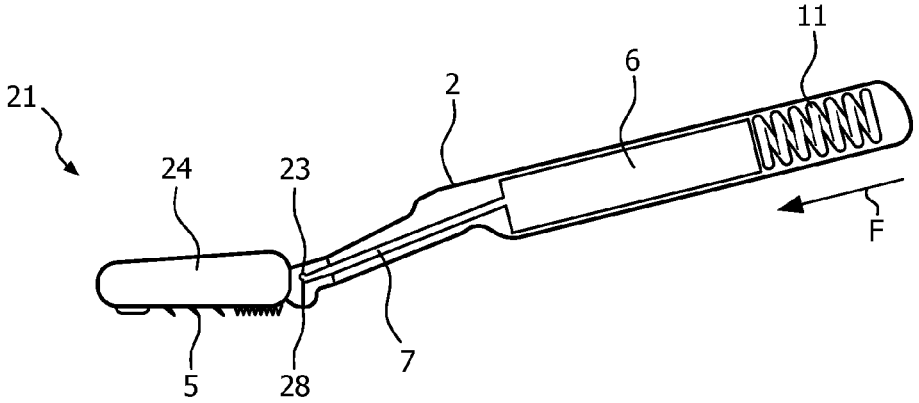
FIG. 3
FIG. 4A
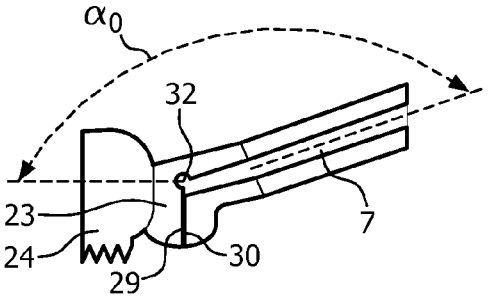
FIG. 4B
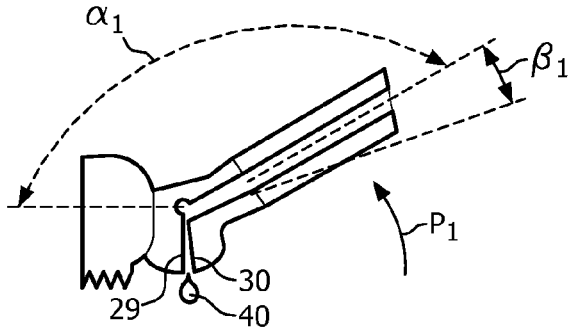
FIG. 4C
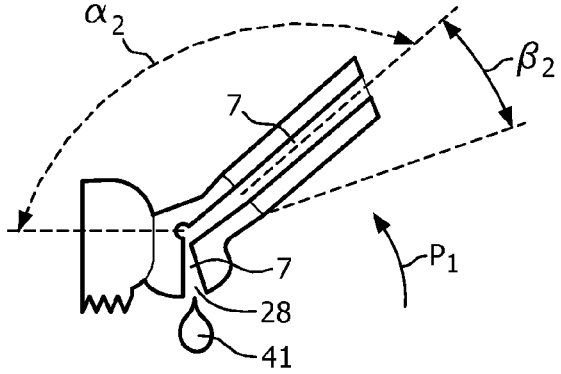

SHAVING DEVICE

FIELD OF THE INVENTION

The invention relates to a shaving device comprising:

a handle provided with a reservoir for holding a fluid, a treatment device provided with at least one shaver element, which treatment device is pivotable with respect to the handle, and a fluid channel extending from the reservoir to an outlet opening at least near the treatment device.

BACKGROUND OF THE INVENTION

In such a shaving device, which is known from WO2008/152601, the treatment device comprises a razor cartridge with shaver elements. Between the treatment device and the reservoir, an adapter neck is located which is provided with a pump. The pump is actuated by a pivotal movement of the adapter neck to pump a fluid like shaving soap, shaving cream or shaving gel etc. from the reservoir through the fluid channel to the outlet opening in the razor cartridge.

The use of fluid applied during shaving by the shaving device improves the shaving performance. However, a disadvantage of the known shaving device is that a pump is needed to control the transport of fluid from the reservoir to the outlet opening.

SUMMARY OF THE INVENTION

It is an object of the invention to provide a shaving device, wherein the flow of fluid through the fluid channel can easily be controlled.

This object is achieved by the shaving device according to the invention in that at least a part of the fluid channel is elastically deformable from a closed position, in which the passage through the fluid channel is closed off, to an opened position, in which the passage through the fluid channel is opened, by pivoting the handle with respect to the treatment device from a rest position to an activated position, and vice versa.

By deforming said part of the fluid channel, for example opposite walls of the fluid channel in said part are moved towards each other or away from each other, due to which the size of the passage in the elastically deformable part of the fluid channel is changed. The amount of fluid which can flow through the fluid channel depends on the size of the passage. If the passage is closed, no fluid will leave the outlet opening. If a user places the treatment device on the skin to start shaving, he can pivot the handle with respect to the treatment device from the rest position to the activated position, in which latter position the passage in the elastically deformable part is opened and fluid will flow from the reservoir to the outlet opening. Furthermore, the use of a fluid channel which is at least partly elastically deformable to close off and to open the passage in the fluid channel from the reservoir to the outlet opening reduces clogging of the fluid in the fluid channel.

An embodiment of the shaving device according to the invention is characterized in that the handle is pivotable with respect to the treatment device from the rest position to the activated position against a spring force.

Due to the spring force, the shaving device will automatically return to the rest position if no external forces are applied on the shaving device. In the rest position no fluid will leave the outlet opening.

By applying a force on the shaving device that is large enough to overcome the spring force, the handle will be pivoted with respect to the treatment device and the passage through the fluid channel will gradually change from the closed position to the opened position.

Another embodiment of the shaving device according to the invention is characterized in that the handle is pivotable with respect to the treatment device from the rest position to an intermediate position, in which latter position the passage in the fluid channel is partly opened.

In the intermediate position, the flow of fluid through the passage and the outlet opening will be less than in the fully opened position. In this manner, a user can amend the flow of fluid as desired.

Yet another embodiment of the shaving device according to the invention is characterized in that the treatment device and the handle are connected to each other by an elastic hinge, wherein the elastically deformable part of the fluid channel is located in the elastic hinge.

If no external force is applied to the elastic hinge, the shaving system is in a rest position in which the fluid channel is closed off. Such an elastic hinge can easily provide a desired spring force, being such that, in operation, a person can overcome the spring force to open the fluid channel and to control the amount of fluid being expelled from the outlet opening.

A further embodiment of the shaving device according to the invention is characterized in that the outlet opening of the fluid channel is located in the elastic hinge.

The fluid will leave the shaving device at the elastic hinge. This makes it possible to obtain a relatively short distance between the reservoir and the outlet opening. In the case that the treatment device can be disconnected from the elastic hinge in order to be replaced, no fluid will be lost. Depending on the direction of movement of the treatment device over the body, the fluid will be applied on the body well before or after the treatment device is passed over the body.

Yet a further embodiment of the shaving device according to the invention is characterized in that the outlet opening of the fluid channel is located in the treatment device.

Since the outlet opening is located in the treatment device, the distance between the outlet opening and the shaver element on the treatment device is relatively small. Thus, the fluid will be applied on the body immediately before or after shaving. Furthermore, by providing the outlet opening in the treatment device, the size of the outlet opening can be chosen independently of the size of the elastic hinge.

Another embodiment of the shaving device according to the invention is characterized in that the reservoir is flexible, wherein the reservoir is pressurized by a spring located in the handle.

Since the reservoir is pressurized by the spring, fluid will be expelled from the flexible reservoir into the fluid channel as soon as the fluid channel is being opened. No pump is needed.

Another embodiment of the shaving device according to the invention is characterized in that the handle and the treatment device are lockable in the rest position.

By locking the handle and the treatment device in the rest position, the fluid channel will remain in its closed position, in which position no fluid can leave the outlet opening. In this way, a user can still use the treatment device but without applying fluid, for example because he feels that already enough fluid has been applied on his skin.

BRIEF DESCRIPTION OF THE DRAWINGS

The invention will be explained in more detail with reference to the drawings, in which FIG. 1 is a schematic cross-section of a first embodiment of a shaving device according to the invention, FIGS. 2*a*-2C are cross sections of a part of the shaving device as shown in FIG. 1, showing the fluid channel in the closed position, an intermediate position and the opened position, respectively, FIG. 3 is a schematic cross-section of a second embodiment of a shaving device according to the invention, FIGS. 4*a*-4C are cross sections of a part of the shaving device as shown in FIG. 3, showing the fluid channel in the closed position, an intermediate position and the opened position, respectively.

Like parts are indicated by the same reference numbers in the Figures.

DETAILED DESCRIPTION OF EMBODIMENTS

FIGS. 1 and 2A-2C show cross sections of a first embodiment of a shaving device, which shaving device 1 comprises a handle 2, an elastic hinge 3 and a razor cartridge 4 forming a treatment device. The razor cartridge 4 is pivotable with respect to the handle 2 by the elastic hinge 3. The razor cartridge 4 is provided with shaver elements 5, like blades.

The handle 2 is provided with a reservoir 6 for holding a fluid, like a fluid for reducing friction between the skin of a person and the shaver elements 5.

A fluid channel 7 extends from the reservoir 6, through the elastic hinge 3, to an outlet opening 8 in the razor cartridge 4. The outlet opening 8 is located on a side of the shaver elements 5 remote from the elastic hinge 3. The part of the fluid channel 7 in the elastic hinge 3 is elastically deformable due to the elasticity of the material of the elastic hinge 3. In the position of the elastic hinge 3 as shown in FIGS. 1 and 2A, opposite walls 9, 10 of the fluid channel 7 in the elastic hinge 3 are located against each other and the passage through the fluid channel 7 is closed off. In this rest position, no external forces are applied on the shaving device 1.

The reservoir 6 is made of a deformable flexible material. The reservoir 6 is pressurized by a pre-loaded spring 11 located on a side of the reservoir 6 remote from the fluid channel 7. Fluid located in the reservoir 6 is pressed into the fluid channel 7 due to the force F exerted on the reservoir 6 by the spring 11. However, the fluid is prevented from flowing out of the outlet opening 8, since the walls 9, 10 of the fluid channel 7 are located against each other, thereby blocking the passage of the fluid through the elastic hinge 3.

The handle 2 can be pivoted with respect to the razor cartridge 4 against the spring force of the elastic hinge 3 about a pivot axis 12 in a direction as indicated by arrow P1. Due to the pivoting movement, the fluid channel 7 is bent, whereby the opposite walls 9, 10 are moved apart and the passage is opened. The size of the passage is determined by the distance between the opposite walls 9, 10, which depends on the amount of bending of the fluid channel 7.

In the position as shown in FIG. 2A, parts of the fluid channel 7 located on both sides of the pivot axis 12 extend at an angle of $\alpha_0$ with respect to each other. In this position, the passage through the fluid channel 7 is closed off and the shaving device 1 is in its rest position.

In the position as shown in FIG. 2B, the handle 2 is pivoted about the pivot axis 12 through an angle $\beta_1$ due to which the fluid channel 7 is bent and opened. The pivoting movement is obtained by placing the razor cartridge 4 on the skin of a person and applying a force on the handle 2 in the direction as indicated by arrow P1. The parts of the fluid channel 7 located on both sides of the pivot axis 12 extend at an angle of $\alpha_1$ with respect to each other, wherein $\alpha_1<\alpha_0$. In this intermediate activated position of the shaving device 1, the passage through the fluid channel 7 is partly opened and fluid in the fluid channel 7 will flow in the direction as indicated by arrow P2.

In the position as shown in FIG. 2C, the handle 2 is pivoted further about the pivot axis 12 through an angle $\beta_2$, wherein $\beta_2<\beta_1$. The parts of the fluid channel 7 located on both sides of the pivot axis 12 extend at an angle of $\alpha_2$ with respect to each other, wherein $\alpha_2<\alpha_1<\alpha_0$. In this activated position of the shaving device, the fluid channel 7 is in its opened position and the passage through the fluid channel 7 is fully opened.

FIGS. 3 and 4A-4C show cross sections of a second embodiment of a shaving device 21, which shaving device 21 comprises a handle 2, an elastic hinge 23 and a razor cartridge 24 forming a treatment device. The razor cartridge 24 is pivotable with respect to the handle 2 by the elastic hinge 23. The handle 2 is provided with a reservoir 6 for holding a fluid. A fluid channel 7 extends from the reservoir 6 to an outlet opening 28 in the elastic hinge 23. In the position of the elastic hinge 23 as shown in FIGS. 3 and 4A, opposite walls 29, 30 of the fluid channel 7 in the elastic hinge 23 are located against each other and the passage through the fluid channel 7 is closed off. In this position, no external forces are applied on the shaving device 21.

The passage through the fluid channel 7 is opened by pivoting the handle 2 with respect to the razor cartridge 24 against a spring force of the elastic hinge 3 about a pivot axis 32 in the elastic hinge 23 in a direction as indicated by arrow P1. The pivoting movement can be obtained by placing the razor cartridge 24 on the skin of a person and applying a force on the handle 2 in the direction as indicated by arrow P1. Due to the pivoting movement, the fluid channel 7 in the elastic hinge 23 is elastically deformed, whereby the opposite walls 29, 30 are moved apart and the passage is opened. The size of the passage is determined by the distance between the opposite walls 29, 30.

In the position as shown in FIG. 4A, the razor cartridge 24 and part of the fluid channel 7 between the pivot axis 23 and the reservoir 6 extend at an angle of $\alpha_0$ with respect to each other. In this position, the passage through the fluid channel 7 between the pivot axis 32 and the outlet opening 28 is closed off.

In the position as shown in FIG. 4B, the handle 2 is pivoted about the pivot axis 32 through an angle $\beta_1$ due to which the part of the fluid channel 7 in the elastic hinge 3 is elastically deformed, whereby the walls 29, 30 are moved apart. The razor cartridge 24 and part of the fluid channel 7 between the pivot axis 23 and the reservoir 6 extend at an angle of $\alpha_1$ with respect to each other, wherein $\alpha_1<\alpha_0$. In this intermediate position, the passage through the fluid channel 7 is partly opened and small droplets 40 of fluid will flow out of the outlet opening 28.

In the position as shown in FIG. 4C, the handle 2 is pivoted further about the pivot axis 32 through an angle $\beta_2$, wherein $\beta_2<\beta_1$. The razor cartridge 24 and part of the fluid channel 7 between the pivot axis 23 and the reservoir 6 extend at an angle of $\alpha_2$ with respect to each other, wherein $\alpha_2<\alpha_1<\alpha_0$. In this opened position, the passage through the fluid channel 7 is fully opened and larger droplets 41 of fluid will flow out of the outlet opening 28.

While the invention has been illustrated and described in detail in the drawings and foregoing description, such illustration and description are to be considered illustrative or exemplary and not restrictive; the invention is not limited to the disclosed embodiments.

For example, it is possible that the razor cartridge is detachably connected to the elastic hinge 3, 23 enabling it to be replaced when the shaver elements 5 have become blunt.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

The invention claimed is:

1. A shaving device comprising:

a handle provided with a reservoir for holding a fluid, a treatment device provided with at least one shaver element, the treatment device and the handle being connected, wherein the treatment device is pivotable with respect to a deformation in the connection between the treatment device and the handle, and a fluid channel extending from the reservoir to an outlet opening at least near the treatment device, wherein at least a part of the fluid channel is elastically deformable from a closed position to an opened position by pivoting the handle about the deformation with respect to the treatment device.

2. The shaving device according to claim 1, wherein the handle is pivotable with respect to the treatment device against a spring force.

3. The shaving device according to claim 1, wherein the handle is pivotable with respect to the treatment device from the closed position to an intermediate position, in which latter position the passage in the fluid channel is partly opened.

4. The shaving device according to claim 1, said deformation representing an elastic hinge, the elastically deformable part of the fluid channel being located in the elastic hinge.

5. The shaving device according to claim 4, wherein the outlet opening of the fluid channel is located in the elastic hinge.

6. The shaving device according to claim 1, wherein the outlet opening of the fluid channel is located in the treatment device.

7. The shaving device according to claim 1, wherein the reservoir is flexible, and the reservoir is pressurized by a spring located in the handle.

8. The shaving device according to claim 1 wherein the handle and treatment device are lockable in the rest position.

* * * * *